US005893632A

United States Patent [19]

Kusagaya et al.

[11] Patent Number: 5,893,632

[45] Date of Patent: Apr. 13, 1999

[54] LAMP BULB FIXING STRUCTURE

[75] Inventors: Masahiro Kusagaya; Shigeyuki Watanabe; Shoichi Fukasawa, all of Shizuoka, Japan

[73] Assignee: Koito Manufacturing Co., Ltd., Tokyo, Japan

[21] Appl. No.: 08/811,190

[22] Filed: Mar. 5, 1997

[30] Foreign Application Priority Data

Mar. 7, 1996 [JP] Japan ..... 8-049795

[51] Int. Cl.[6] ..... H01R 33/46

[52] U.S. Cl. ..... 362/226; 362/438; 362/440

[58] Field of Search ..... 362/226, 310, 362/437, 438, 440, 448, 61, 457

[56] References Cited

U.S. PATENT DOCUMENTS 4,682,274 7/1987 Freudenreich et al. ..... 362/226
4,760,506 7/1988 Mochizuki et al. ..... 362/226
4,764,854 8/1988 Matsune et al. ..... 362/226
4,829,408 5/1989 Haydu ..... 362/226
4,841,419 6/1989 Ohishi ..... 362/226
4,926,301 5/1990 Liverance et al. ..... 362/226
5,559,679 9/1996 Liedtke ..... 362/226

*Primary Examiner*—Alan Cariaso
*Attorney, Agent, or Firm*—Sughrue, Mion, Zinn, Macpeak & Seas, PLLC

[57] ABSTRACT

In a bulb fixing structure, a bulb mounting hole portion has an inner wall and an outer wall that stand concentrically with the bulb mounting hole. A fixture has a dish-like shape having a peripheral wall portion in which interlocking grooves are formed. Each interlocking groove is partially defined by at least one claw portion. The fixture can be readily fixed to the bulb mounting hole portion with a high fixing strength by inserting the peripheral wall portion into the space between the inner and outer walls so that the claw portions of the interlocking grooves bite into rib walls that stand between the inner and outer walls. When the fixture is thus fixed, the inner and outer walls cover the peripheral wall, protecting it from an external force.

19 Claims, 11 Drawing Sheets

LAMP BULB FIXING STRUCTURE

BACKGROUND OF THE INVENTION

1. Field of the Invention

The present invention relates to a structure for fixing a bulb to a lamp and, more particularly, to a lamp bulb fixing structure having a fixture for fixing a socket portion of the bulb to a lamp body, a reflector or the like.

2. Description of the Related Art

Vehicular lamps for motor vehicles and the like adopt a fixing structure for detachably fixing a bulb using a bulb mounting hole formed in a back side portion of the reflector or the lamp body, in order to meet requirements for bulb replacement. FIG. 12 shows an example of such bulb fixing structure. A circular ring-shaped mount part 103 is integrally connected to or formed together with a bulb mounting hole portion 102 of a reflector 101 disposed in a lamp body. A fixture 104 is fixed to the mount part 103 with screws 105. The fixture 104 has the shape of a circular shallow dish with an insert hole 107 formed on its bottom portion 106 for inserting a bulb to be fixed. An inner periphery defining the insert hole 107 has a plurality of engagement cut outs 108 that are formed in different positions along the periphery.

A bulb (not shown) to be fixed to the bulb mounting hole portion 102 is integrated with a bulb socket that has a boss portion. The boss portion has projected engaging pieces that are formed in a plurality of positions distributed in the circumferential direction. The bulb socket of the bulb can be fixed to the fixture 104 of the above-described fixing structure by fitting the boss into the insert hole 107 of the fixture 104 so that the projected engaging pieces of the boss substantially engage or align with the engagement cutouts 108 of the fixture 104, and then turning the bulb a small angle about its axis so that the engaging pieces are clamped between the fixture 104 and the end face of the bulb mounting hole portion 102. The bulb can be detached simply by conducting the procedure in the reverse order.

However, since the fixture is screwed to the reflector in the conventional bulb fixing structure, the screws required for the fixture add to the number of component parts of the fixing structure. Such an increase in the number of component parts is not desirable for cost reductions. Furthermore, the operation of tightening the screws adds to the manhours for assembly of the lamp.

SUMMARY OF THE INVENTION

Accordingly it is an object of the present invention to provide a lamp bulb fixing structure that has a reduced number of component parts and allows a reduction of assembly manhours.

According to the present invention, there is provided a lamp bulb fixing structure comprising a bulb mounting hole portion formed in one of a lamp body of a lamp and a reflector of the lamp, and a fixture to be fixed to the bulb mounting hole portion. The fixture is capable of supporting a bulb in a detachably fixed manner, and has an interlocking portion that interlocks with a portion of the bulb mounting hole portion. An outer wall and an inner wall stand concentrically on the bulb mounting hole portion, and define a space therebetween for receiving a peripheral portion of the fixture. The fixture is fixed to the bulb mounting hole portion by the peripheral portion of the fixture entering said space so that the interlocking portion of the fixture interlocks with the portion of the bulb mounting hole portion.

The present invention may further have a construction as described below. The portion of the bulb mounting hole portion to be interlocked includes a rib wall standing between the inner and outer walls, and the interlocking portion includes an interlocking groove formed in a peripheral portion of the fixture, corresponding to the rib wall. The interlocking groove is partially defined by at least one claw portion. When the peripheral portion of the fixture is inserted into the space between the inner and outer walls, the claw portion of the interlocking groove bites into the rib wall.

In another possible construction of the invention, the inner wall has a small groove, and a bottom portion of the fixture has a bendable interlocking piece portion having an arrowhead-like portion. The interlocking piece portion is formed at a position corresponding to that of the small groove. When the interlocking piece portion is bent into the small groove portion, the arrowhead-like portion of the interlocking piece portion bites into a wall portion that partially forms the small groove portion.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the present invention will be described in detail hereinafter with reference to the accompanying drawings.

Figure 1:
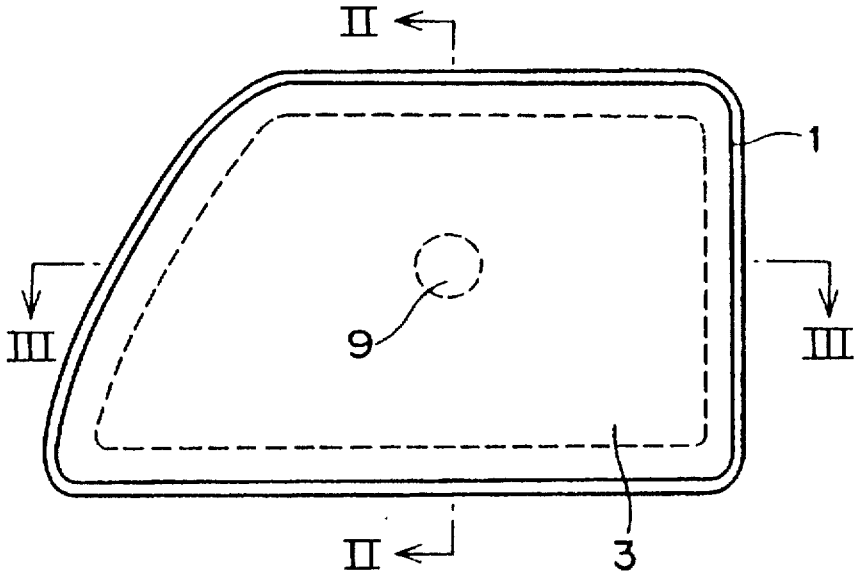
FIG. 1 is an elevation view of a single-bulb head lamp for a motor vehicle, incorporating a first embodiment of the present invention.
Figure 2:
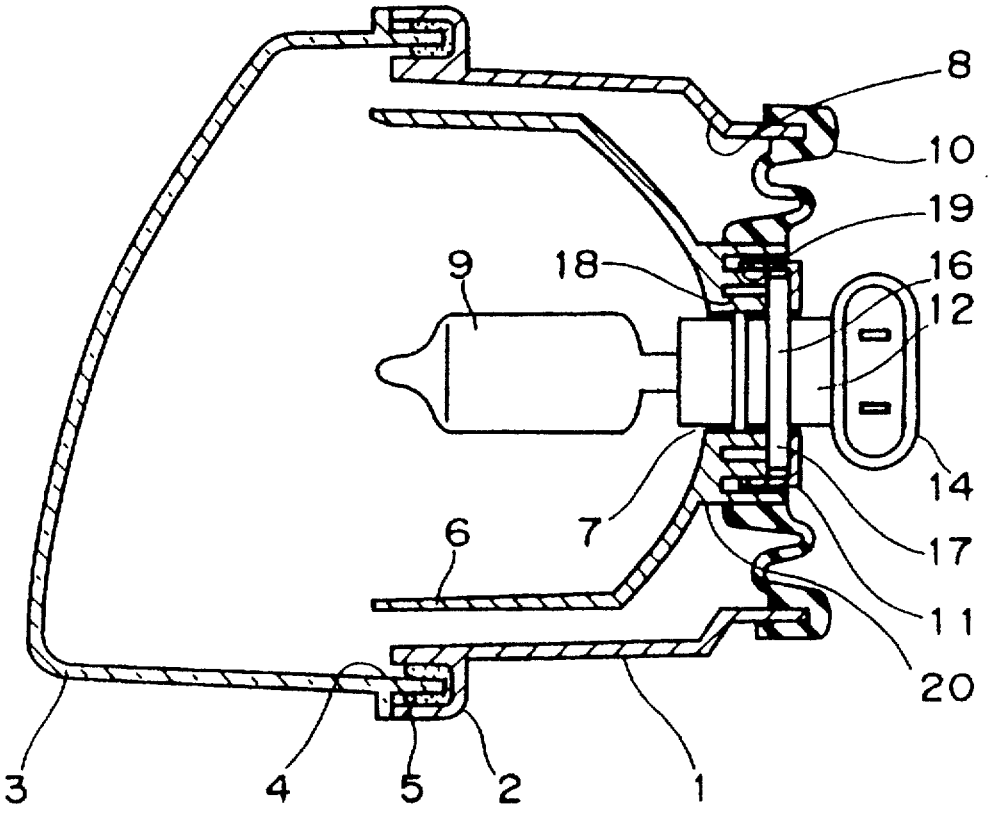
FIG. 2 is an enlarged sectional view of the lamp taken on the vertical plane II—II of FIG. 1.
Figure 3:
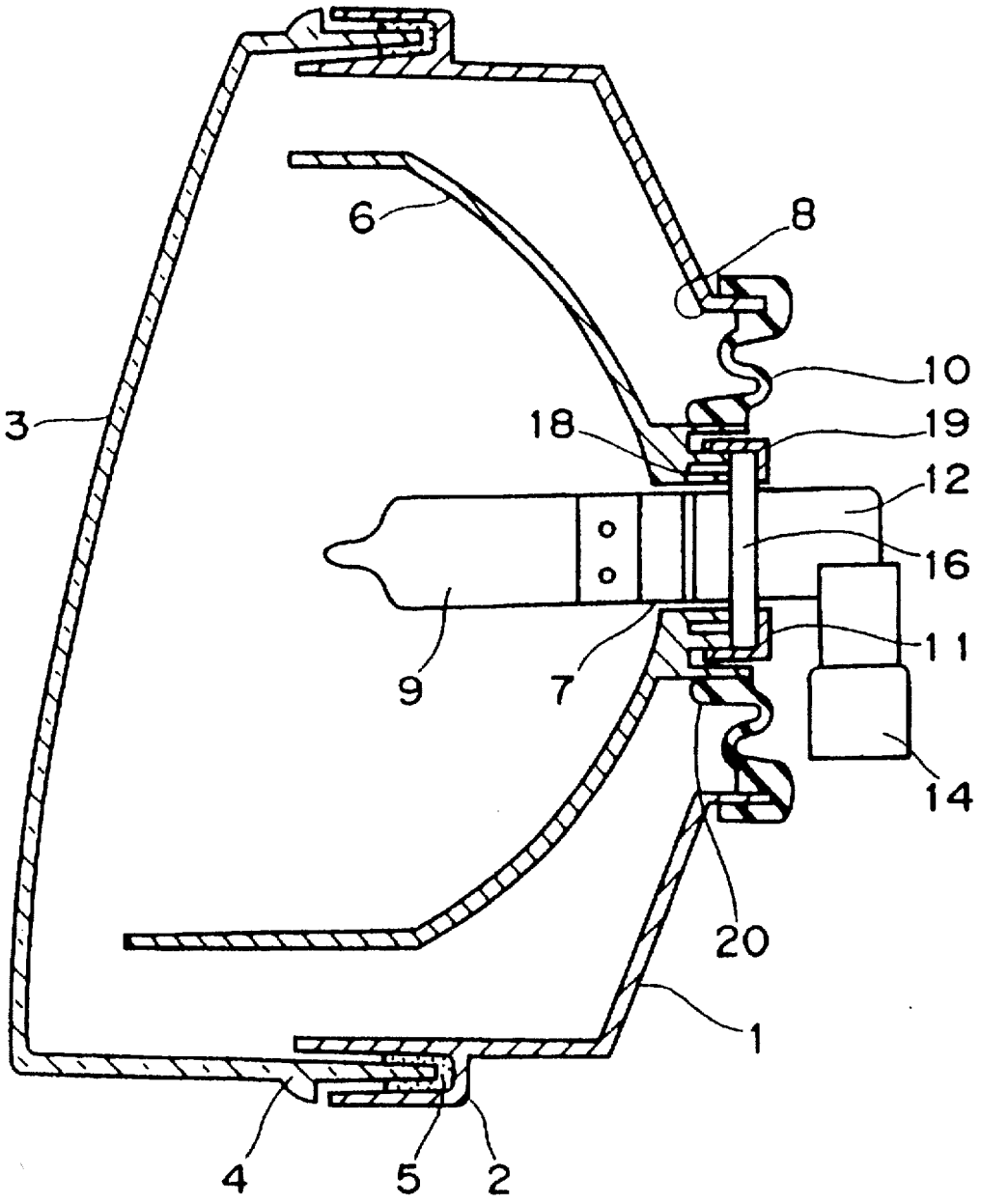
FIG. 3 is an enlarged sectional view of the lamp taken on the horizontal plane III—III of FIG. 1.

Referring to FIGS. 1 through 3, which illustrate a motor-vehicular single bulb headlamp incorporating a first embodiment of the lamp bulb fixing structure of the present invention, a lamp body 1 has a seal groove 2 that is formed on a front opening peripheral edge. A periphery 4 of a lens 3 is fixed into the seal groove 2 in a sealing manner using a sealant 5. The lens 3 defines a lamp chamber inside the lamp body 1. Disposed in the lamp chamber is a reflector 6 that is a resin molding whose surface has been treated to form a reflecting surface. The inclination position of the reflector 6 is adjustable in the up-down and right-left directions by an aiming mechanism (not shown). A bulb mounting hole portion 7 defining a bulb mounting hole is formed in a back side portion of the reflector 6. The bulb mounting hole portion 7 is positioned in an opening portion 8 formed in a back face of the lamp body 1, and is exposed to the outside in the opening defined by the opening portion 8. A bulb 9 is detachably fixed into the bulb mounting hole portion 7 of the reflector 6 as described in detail below. The gap between the bulb 9 and the opening portion 8 of the lamp body 1 is sealed by a rubber cap 10 fitted to the opening portion 8.

Figure 4:
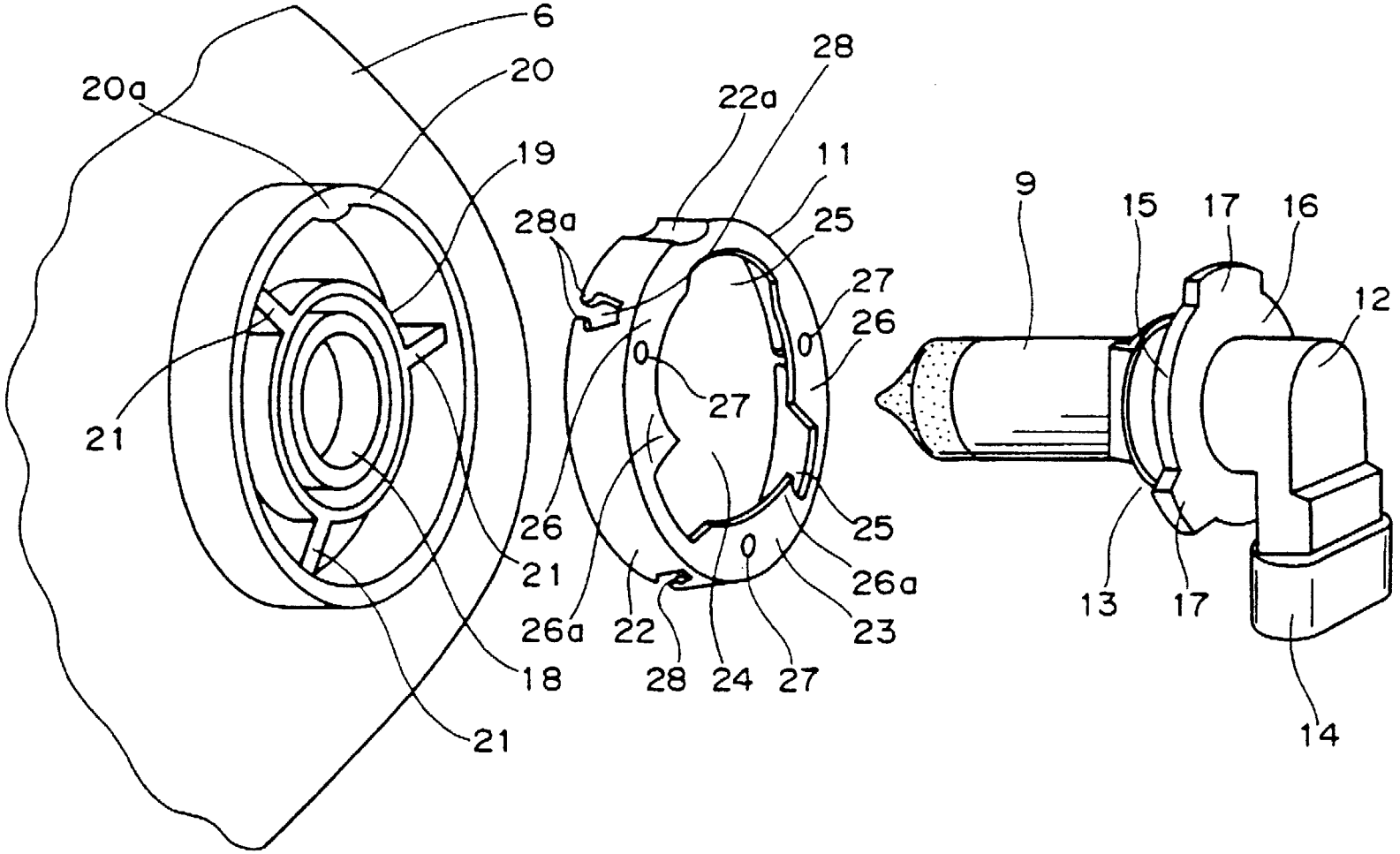
FIG. 4 is an enlarged, exploded perspective view of a portion of the lamp shown in FIG. 1.

FIG. 4 is an exploded perspective view illustrating a structure of the bulb mounting hole portion 7 for fixing the bulb 9. The lamp bulb fixing structure comprises a fixture 11 to be fixed integrally to the bulb mounting hole portion 7 of the reflector 6, and the bulb 9 to be supported in the bulb mounting hole portion 7 by the fixture 11. The bulb 9 is integrally fitted into a bulb socket 12 formed of an electrically insulating material. The bulb socket 12 has an engaging portion 13 that engages with the fixture 11, and a connector portion 14 that is electrically connected to the bulb 9. The engaging portion 13 comprises a cylindrical boss 15 and an circular engaging plate 16 protruding radially from the outer peripheral face of the boss 15. The engaging plate 16 has a plurality of radially-projected engaging pieces 17 that are formed at different positions on its circumference. The engaging pieces 17 engage with the fixture 11. The connector portion 14 is connectable to a connector that is connected to a cord connecting to an electrical power source installed in a motor vehicle (not shown).

Figure 5A:
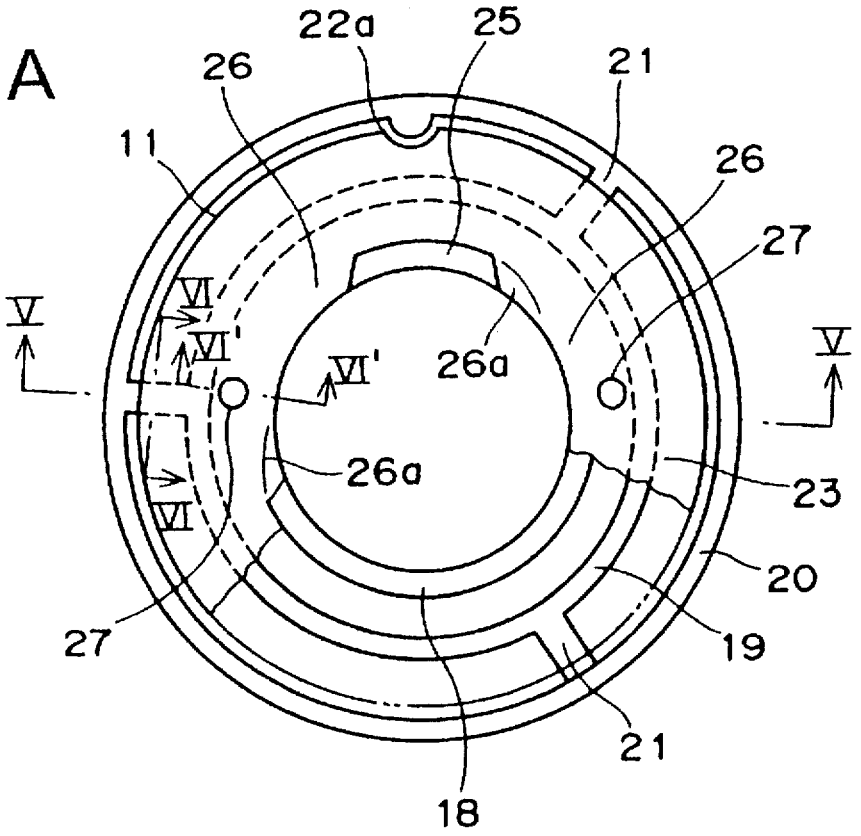
FIG. 5*a* is an elevation view of a fixture fixed to a bulb mounting hole portion.
Figure 5B:
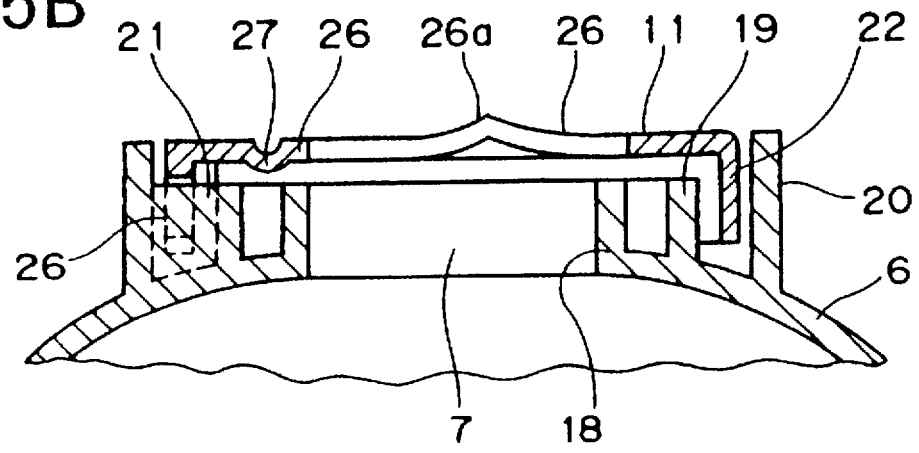
FIG. 5*b* is a sectional view taken on the plane V—V line of FIG. 5*a;*

FIGS. 5*a* and 5*b* are a partially broken-away elevation view and a sectional view on the plane V—V, respectively, where the fixture 11 is fixed to the bulb mounting hole portion 7. An annular mounting sleeve 18 is formed in the bulb mounting hole portion 7 provided in a back side portion of the reflector 6. The annular mounting sleeve 18 forms the inner peripheral face of the bulb mounting hole portion 7. The mounting sleeve 18 is surrounded by an inner wall 19 and an outer wall 20 that are formed as concentric circular rings and unitarily with the reflector 6, and that are spaced from each other by an appropriate interval. The upper end of the inner wall 19 is slightly lower than that of the outerwall 20. A plurality of rib walls 21 are provided in different positions in the circumferential direction in an annular space defined between the inner and outer walls 19 and 20. The rib walls extend in radial directions. According to this embodiment, three rib walls 21 are provided. The thickness of each rib wall 21 slightly increases with progression from the upper end toward the bottom end.

The fixture 11 has been formed into the shape of a circular shallow dish by working a metal plate. The diameter of the outer peripheral face of a peripheral wall portion 22 of the fixture 11 is smaller than the inside diameter of the outer wall 20 provided in the bulb mounting hole portion 7. The diameter of the inner peripheral face of the peripheral wall portion 22 is greater than the outside diameter of the inner wall 19. A bottom portion 23 of the fixture 11 has, in its central portion, a circular insert hole 24 through which the boss 15 of the valve socket 12 is to be inserted. A plurality of engagement cutouts 25, corresponding to the engaging pieces 17 of the bulb socket 12, are formed in different positions along a periphery defining the insert hole 24. The portions between these engagement cutouts 25 form clamping pieces 26 that cooperate with the top end surface of the inner wall 19 to clamp the engaging pieces 17 of the bulb socket 12.

An end portion of each clamping piece 26 which portion faces the corresponding engaging piece 17 when the bulb socket 12 is turned to fix it, is inclined or bent outward, forming a guide portion 26*a* that facilitates entrance of the corresponding engaging piece 17 into an inside space between the clamping piece 26 and the end surface of the inner wall 19. In addition, each clamping piece 26 is provided with a projection 27 protruding inward. The projections 27 are designed to abut against the surfaces of the engaging pieces 17 when the bulb socket 12 is fixed.

The peripheral wall portion 22 of the fixture 11 has three cut-out interlocking grooves 28 that extend from the end edge toward the bottom portion. The three interlocking grooves 28 are formed at positions in the circumferential direction corresponding to the positions of the three rib walls 21. The width of each interlocking groove 28 is substantially equal to the wall thickness of the rib walls 21. Each interlocking groove 28 is provided with claws 28*a* that are formed at the opposite side ends of the groove 28 and that are projected into the inside space of the groove 28. The peripheral wall portion 22 of the fixture 11 has a positioning recess 22*a* that is formed on the outer peripheral surface of the peripheral wall portion 22 corresponding to a positioning protrusion 20*a* protruding radially inward from the inner peripheral surface of the water wall 20.

Figure 6A:
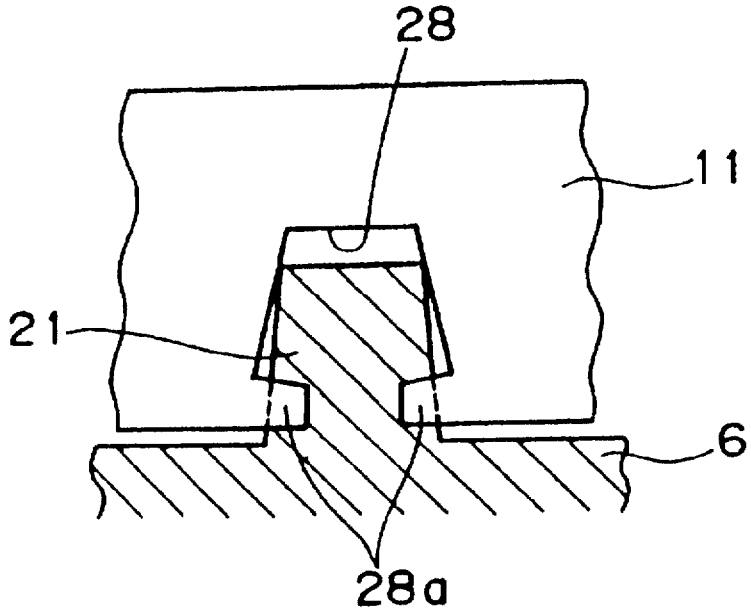
FIG. 6*a* is an enlarged sectional view taken on the plane VI—VI of FIG. 5*a*.
Figure 7A:
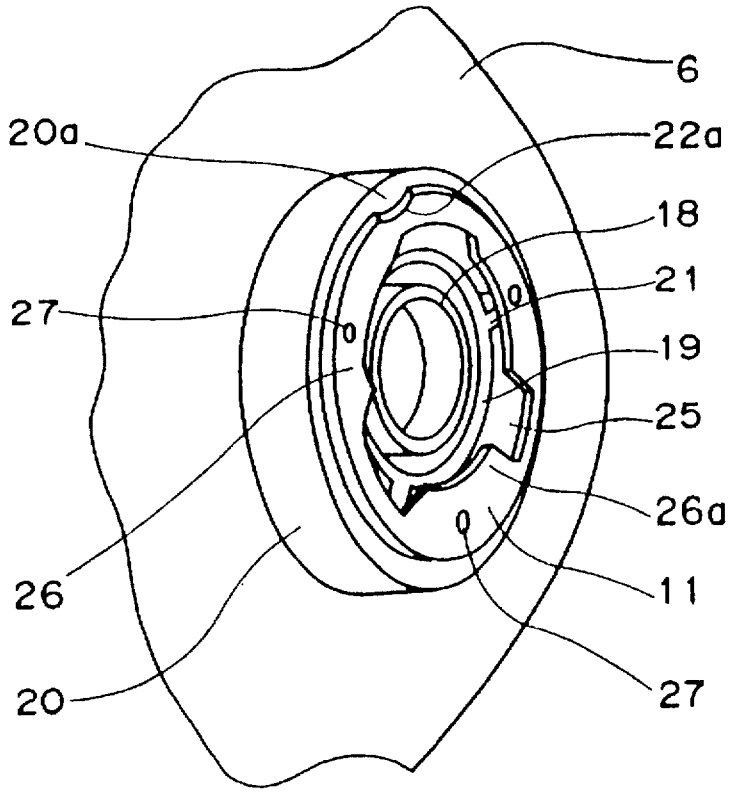
FIG. 7*a* is a perspective view illustrating the mounting of the fixture.

In this fixing structure, the fixture 11 is first fixed to the bulb mounting hole portion 7 of the reflector 6, as shown in FIG. 7*a*. In this fixing operation, the position of the fixture 11 in the circumferential direction is defined by facing the recess 22*a* to the protrusion 20*a* of the outer wall 20 of the bulb mounting hole portion 7, and the peripheral wall portion 22 is positioned in the annular space between the inner wall 19 and the outer wall 20, so that the interlocking grooves 28 face the corresponding rib walls 21. The fixture 11 is then pressed in the direction of its axis so that the peripheral wall portion 22 is forced into the annular space to fix the fixture 11. By the pressing force, the rib walls 21 relatively enter the interlocking grooves 28 and, at the same time, the claws 28*a* formed at the groove side ends bite into the faces of the resin-made rib walls 21 as shown in the enlarged sectional view of FIG. 6*a* taken on the plane VI—VI of FIG. 5*a*. When the fixture 11 is pushed into the annular space to an extent where the end edge of the peripheral wall portion 22 substantially reaches the bottom of the annular space, the claws 28*a* have bitten deep into the rib walls 21 because the wall thickness of the rib walls 21 becomes greater toward the bottom end. The interlocking structure achieved by the biting of the claws 28*a* into the rib walls 21 firmly fixes the fixture 11 to the reflector 6.

Figure 6B:
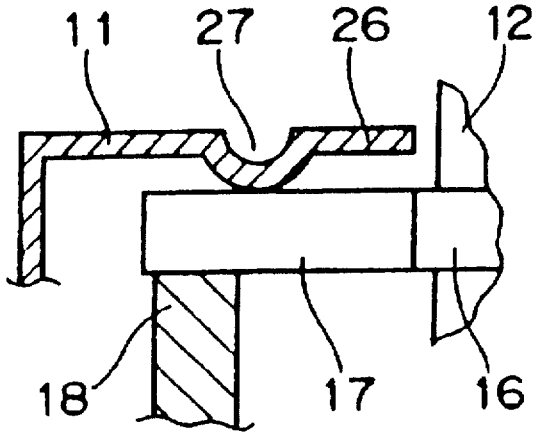
FIG. 6*b* is an enlarged sectional view taken on the plane VI—VI of FIG. 5*a;*
Figure 7B:
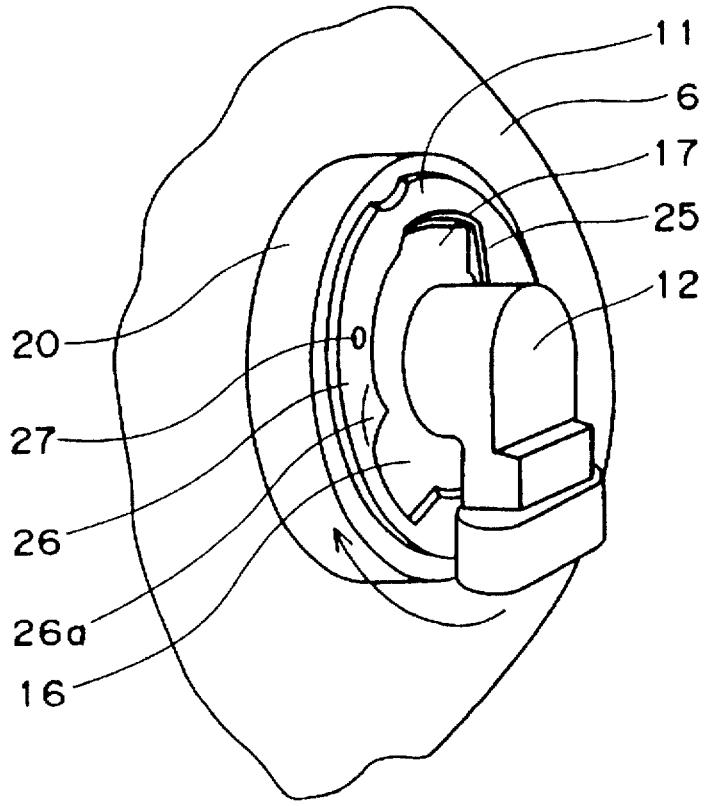
FIG. 7*b* is a perspective view illustrating the mounting of a bulb.

Then, the bulb socket 12 can be fixed to the reflector 6 by the intervening fixture 11, as shown in FIG. 7*b*, by the following procedure. The bulb 9 is inserted into the insert hole 24 of the fixture 11 and moved farther inward to insert the boss 15 into the insert hole 24 and insert the engaging pieces 17 formed on the engaging plate 14 into the engagement cutouts 25, until the front surfaces of the engaging pieces 17 contact the end surface of the inner wall 19. Then, the bulb socket 12 is turned around its axis so that the engaging pieces 17 are clamped between the inner wall 19 and the clamping pieces 26 of the fixture 11, thus fixing the bulb socket 12. Since an end portion of each clamping piece 26 is inclined outward to form the guide portion 26*a* as described above, the guide portions 26*a* of the clamping pieces 26 smoothly guide the engaging pieces 17 of the fixture 11 into the gap between the clamping pieces 26 and the end surface of the inner wall 19, thus facilitating the fixing of the bulb 9 to the reflector 6. While the bulb 9 is fixed, the surfaces of the engaging pieces 17 abut against the projections 27 formed on the clamping pieces 26, as shown in the sectional view of FIG. 6*b* taken on the plane VI—VI of FIG. 5*a*, so as to increase the force of the clamping pieces 26 that presses the engaging pieces 17 against the end surface of the inner wall 19. The force for fixing the bulb socket 12 can thus be increased.

Thus, the bulb fixing structure according to the first embodiment establishes the interlock between the interlocking grooves 28 and the rib walls 21 to fix the fixture 11 to the reflector 6, simply by pushing the peripheral wall portion 22 of the fixture 11 into the annular space between the inner wall 19 and the outer wall 20 of the bulb mounting hole portion 7. The embodiment thereby eliminates the need for screws, and correspondingly reduces the number of component parts. The elimination of the operation of screwing the fixture 11 correspondingly reduces the assembly manhours. Furthermore, since when the fixture 11 is fixed, the peripheral wall portion 29 is disposed inside the outer wall 20 and will not be exposed to the outside, there is substantially no danger that the peripheral wall portion 22 of the fixture 11 will receive an external force by contacting an external object such as a vehicle body. Thus the embodiment substantially eliminates the danger that the fixture 11 will fall apart by an external force.

Figure 8A:
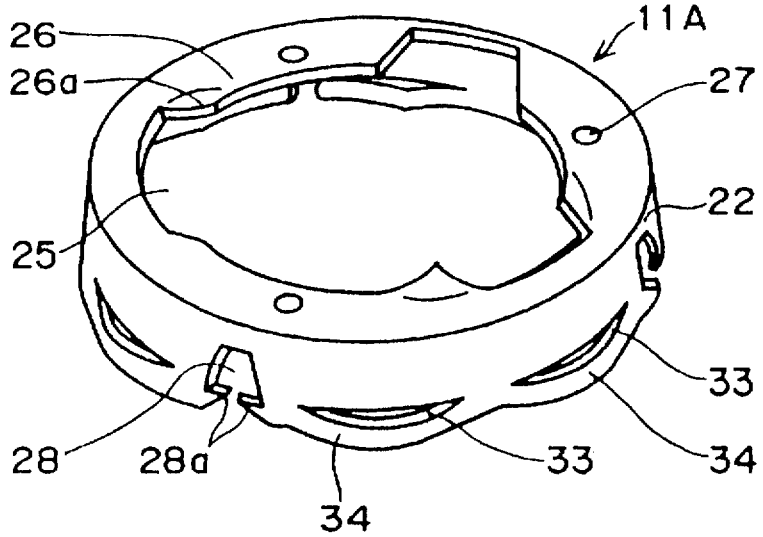
FIG. 8*a* is a perspective view of a fixture according to a second embodiment of the invention.
Figure 8B:
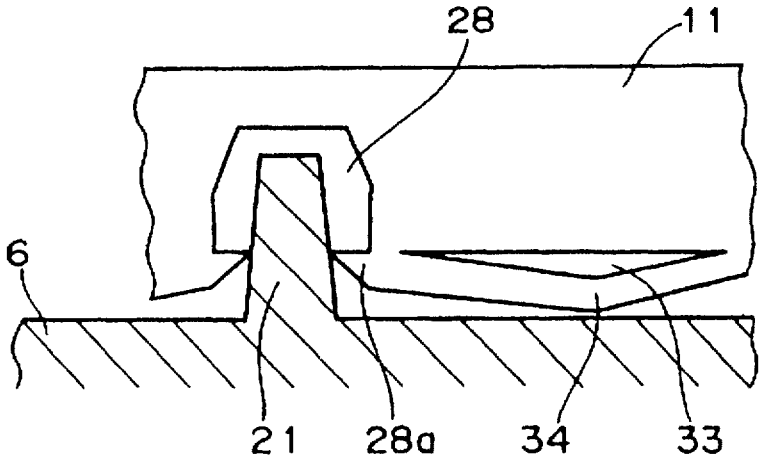
FIGS. 8*b* and 8*c* are sectional views similar to the view of FIG. 6*a*, illustrating how the fixture shown in FIG. 8*a* operates while being mounted.
Figure 8C:
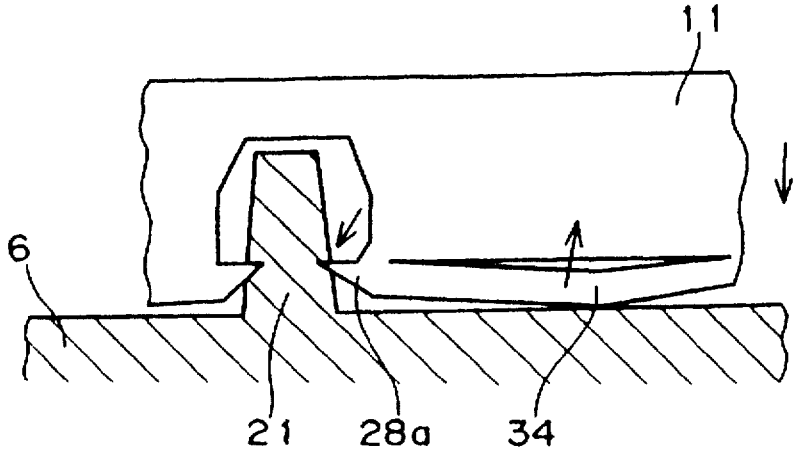

FIG. 8*a* is a perspective view of a fixture according to a second embodiment of the present invention, and FIGS. 8*b* and 8*c* are sectional view illustrating how the fixture operates while being mounted. Comparable numerals are used to refer to portions comparable to those in the first embodiment. The second embodiment has an improved feature of the fixing structure, compared with the first embodiment. In a fixture 11A according to the second embodiment, each of claws 28*a* provided on the opposite sides of each interlocking groove 28 has a distal end of a triangular acute shape. In addition, slits 33 are formed in the peripheral wall portion 22 of the fixture 11A, extending along the peripheral edge of the peripheral wall portion 22 from sites near the claws 28*a*. Each slit 33 partially defines a deformable portion 34 which extends along the slit 33 and which is bent or curved outwardly from the slit 33 so that a projected edge portion of the deformable portion 34 is projected, compared with remote portions of the peripheral edge of the peripheral wall portion 22.

As in the first embodiment, the fixture 11A is fixed by inserting the peripheral wall portion 22 into the annular space between the inner wall 19 and the outer wall 20 of the bulb mounting hole portion in such a manner that the rib walls 21 respectively enter the interlocking grooves 28 as shown in FIG. 8*b*. After the projected edge portions of the deformable portions 34 contact the bottom of the annular space between the inner wall 19 and the outer wall 20, the fixture 11A is pushed farther into the annular space, so that the deformable portions 34 deform into the slits 33 with the slits 33 compressed as shown in FIG. 8*c*. Since the deformation of each deformable portion 34 involves a rotation with a fulcrum or center being a region near a boundary portion between the slit 33 and the adjacent claw 28*a*, the claw 28*a*, located on the opposite side of the fulcrum, rotates in-the opposite direction in such a manner that the claw 28*a* moves and protrudes into the inside space of the interlocking groove 28. By the protruding motion, each claw 28*a* bites into the side face of the adjacent rib wall 21. Thus, the biting of the claws 28*a* fixes the fixture 11A to the rib walls 21.

The bite of each claw 28*a* into the rib wall 21 forms an undercut such that the claw 28*a* is substantially prevented from moving in the slipping-off direction toward the distal end of the rib wall 21. Thereby, the biting of the claws 28*a* according the second embodiment can provide a greater fixing strength for the fixture 11A than the biting of the claws 28*a* according to the first embodiment, thus substantially preventing the fixture 11A from falling apart. In addition, the force that occurs in the claws 28*a* during the biting operation is greater than the deforming force that occurs in the deformable portions 34 because, according to the principle of levers, the force occurring in each claw 28*a* is in inverse proportion to the ratio of the length of the claw portion measured from the fulcrum to the length of the deformable portion from the fulcrum. Thus, the second embodiment can readily provide a sufficient force for the biting of the claws 28*a* into the rib walls 21.

Figure 9A:
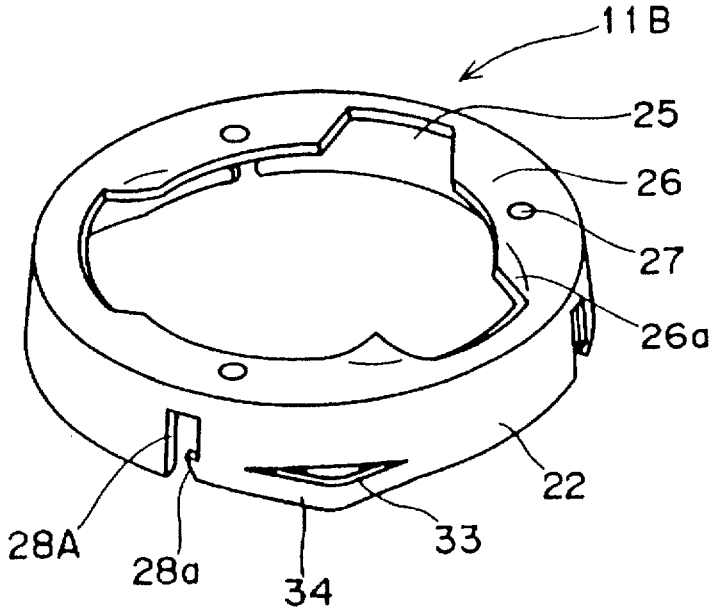
FIG. 9*a* is a perspective view of a fixture according to a third embodiment of the invention.
Figure 9B:
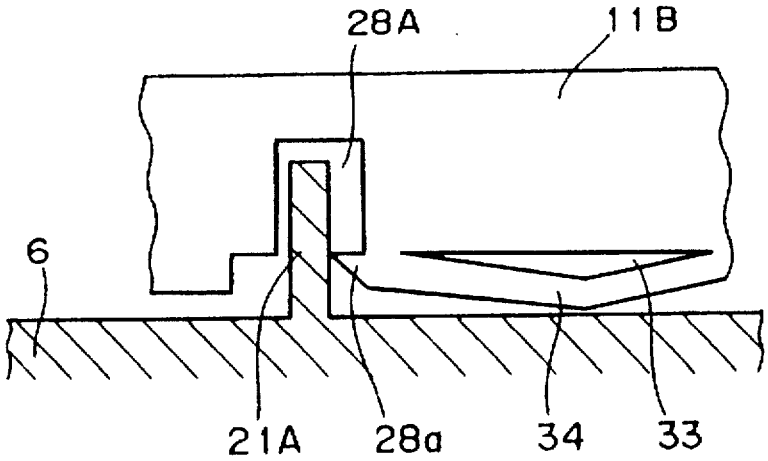
FIGS. 9*b* and 9*c* are sectional views illustrating how the fixture shown in FIG. 9*a* operates while being mounted
Figure 9C:
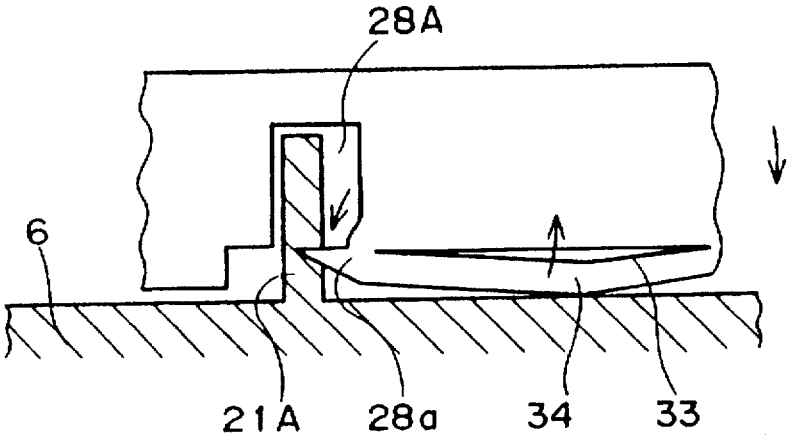

FIG. 9*a* is a perspective view of a fixture 11B according to a third embodiment of the invention, and FIGS. 9*b* and 9*c* are sectional views illustrating how the fixture 11B operates while being mounted. The third embodiment is the same as the second embodiment in that the fixture 11B is provided with the slits 33 and the deformable portions 34. However, according to the third embodiment, rib walls 21A provided in a bulb mounting hole portion have a less wall thickness than the rib walls 21 according to the first and second embodiments, and the width of interlocking grooves 28A formed in the fixture 11B is correspondingly reduced. In addition, each groove 28A is provided with only one claw 28*a* that is formed at a side of the groove 28A. The slits 33 are formed in only portions of the peripheral wall portion 22 that respectively adjoin the claws 28*a*. A peripheral edge portion along each slit 33 forms a deformable portion 34 projected outward compared with other portions of the peripheral edge of the peripheral wall portion 22.

The procedure of setting the fixture 11B to the bulb mounting hole portion is substantially the same as in the second embodiment. However, when a claw 28*a* bites into the adjacent rib wall 21A as shown in FIGS. 9*b* and 9*c*, the claw 28*a* completely or approximately completely penetrates the rib wall 21A since the rib wall 21A is relatively thin. If the claw 28*a* completely penetrates the rib wall 21A, the distal end of the claw 28*a* protrudes from the opposite side of the rib wall 21A. Thereby, the rib wall 21A is substantially clamped between the claw 28*a* and an inner face of the interlocking groove 28A, so that the fixing strength of the fixture 11B will be further increased.

Figure 10A:
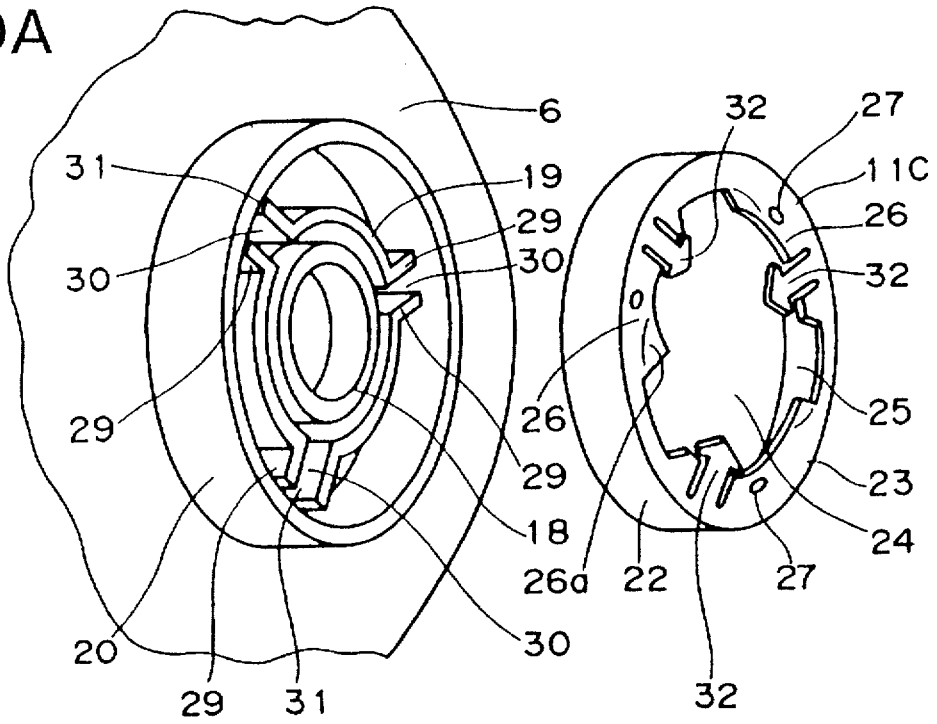
FIG. 10*a* is an exploded perspective view of a portion of a fourth embodiment of the invention.
Figure 10B:
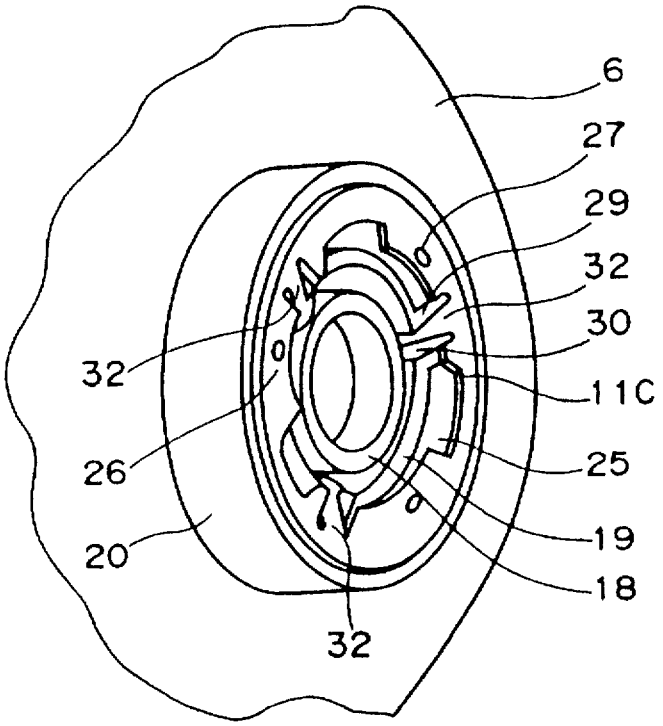
FIG. 10*b* is a perspective view of the portion of the fourth embodiment, wherein a fixture is fixed to a bulb mounting hole portion.

FIGS. 10*a* and 10*b* are perspective views of a portion of a fourth embodiment of the invention, wherein comparable numerals are used to refer to portions comparable to those of the first embodiment. According to the fourth embodiment, an inner wall 19 formed in the bulb mounting hole portion 7 of the reflector 6 has three gaps that are formed at three circumferential positions, and three pairs of radially extending rib walls 29 are formed in such a manner that each pair of rib walls 29 substantially sandwich one of the gaps, as shown in FIG. 10*a*. Thereby, a small groove portion 30 is formed near each gap, with the plane of cross-section of the groove 30 extending in circumferential directions. The outer ends of the rib walls 29 are apart from the inner peripheral surface of the outer wall 20 and, thus, grooves 31 are formed therebetween, with the planes of cross-section of the grooves 31 extending in radial directions. In a fixture 11C according to this embodiment, a pair of radially extending slits are formed in each of clamping pieces 26 in such positions that the operation of inserting the bulb socket 12 will not be impeded. Formed between each pair of slits is an projected interlocking piece 32 whose distal end portion has the shape of an arrowhead. The width of the arrowhead portion of each interlocking piece 32 is slightly greater than the width of the small groove portions 30. In addition, each clamping piece 26 has a projection 27 as in the first embodiment.

Figure 11A:
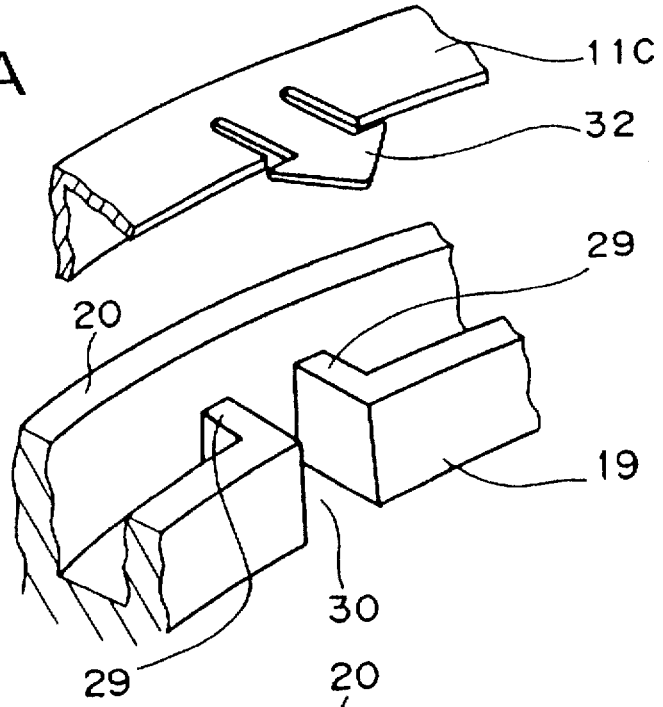
FIGS. 11*a*, 11*b* and 11*c* illustrate a structure for fixing the fixture shown in FIGS. 10*a* and 10*b*.
Figure 11B:
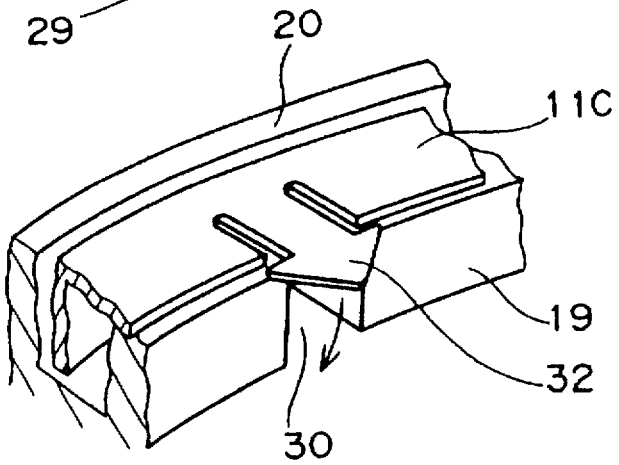
Figure 11C:
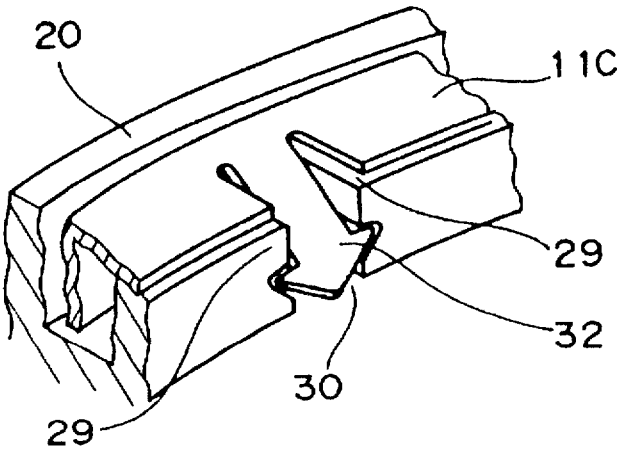
Figure 12:
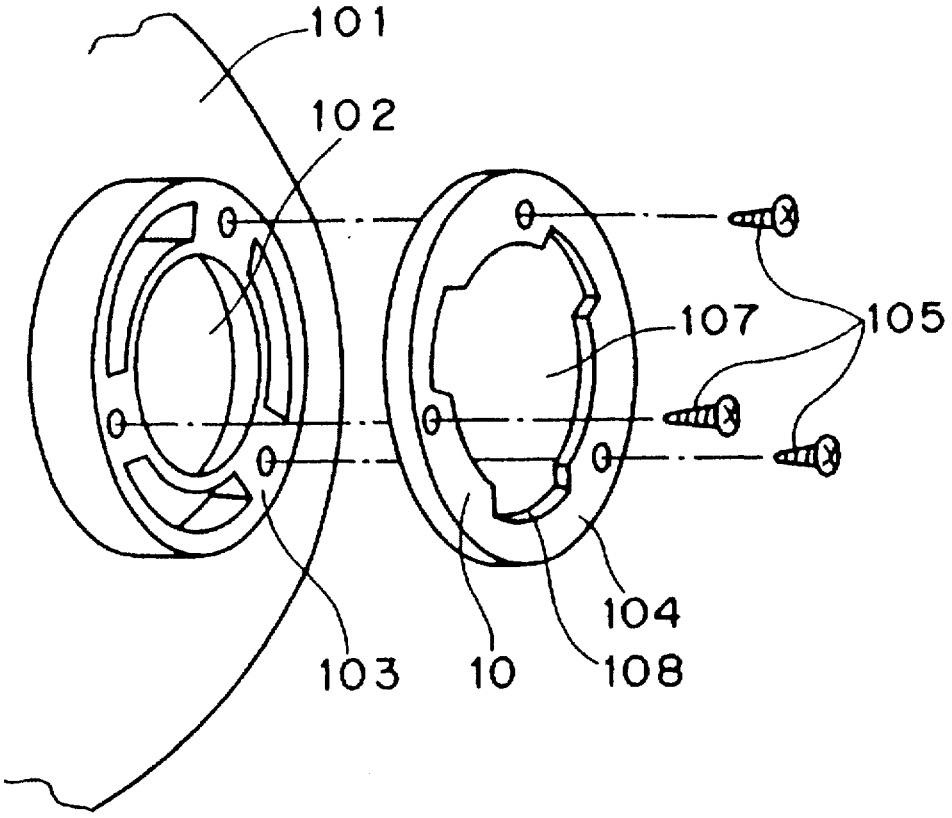
FIG. 12 is a perspective view of a conventional structure for fixing a fixture.

After the fixture 11C is inserted into the space between the inner wall 19 and the outside wall 20 as indicated in FIGS. 10*a* and 10*b*, the interlocking pieces 32 are bent downward using an appropriate tool such as a punch, as indicated in FIGS. 11*b* and 11*c*. When an interlocking piece 32 is bent as shown in FIG. 11*c*, the arrowhead portion of the interlocking piece 32 has entered the adjacent small groove portion 30, and has bitten into the inner side portions of the rib walls 29 standing on opposite sides of the small groove portion 30. This manner of biting of the arrowhead portions fixes the fixture 11C to the reflector 6 as shown in FIG. 10*b*. The biting of the interlocking pieces 32 into the rib walls 29 increases the fixing strength. In addition, since the bites of the arrowhead portions into the rib walls 29 form undercuts such that the interlocking pieces are substantially prevented from moving in the falling-apart direction, this fixing structure substantially prevents the fixture 11C from falling apart.

Thus, the fourth embodiment also eliminates the need for screws in fixing the fixture and correspondingly reduces the number of component parts. Furthermore, since when the fixture 11C is fixed, the peripheral wall portion 22 is placed in the space between the inner wall 29 and the outer wall 20 and will not be exposed to the outside, there is substantially no danger that the fixture 11C will fall apart by an external force, as in the first embodiment.

The rib walls, the interlocking grooves, the small groove portions, and the interlocking pieces according to the above embodiments may be provided in any number and in any circumferential positions. However, it is preferred to set appropriate numbers, since excessively small numbers of these components can reduce the fixture fixing strength to an undesirable level, and excessively large numbers can make difficult the design or production of the fixtures and, in the case of the second embodiment, will increase the assembly manhours.

Although the above embodiments are described in conjunction with the fixing of the fixture to the bulb mounting hole portion of the reflector, it is also possible to apply the fixing structure of the invention to the fixing of a fixture to a bulb mounting hole portion formed on a lamp body. Furthermore, the bulb fixing structure of the present invention may also be applied to a head lamp provided with two bulbs disposed in the lamp body, or lamps other than vehicle lamps.

Although the above embodiments are described in conjunction with the fixing structure combining the rib walls and the interlocking grooves or the fixing structure combining the small groove portions and the interlocking pieces having arrowhead-like portions, it is also possible to incorporate both structures.

As described above, in the bulb fixing structures according to the preferred embodiments, the bulb mounting hole portion provided in a reflector or a lamp body has concentrically standing inner and outer walls. When the fixture is fixed to the bulb mounting hole portion, the peripheral wall portion of the fixture is inserted into the space between the inner and outer walls and portions of the fixture are interlocked with portions of the bulb mounting hole portion. Therefore, the preferred embodiments facilitate and simplify the operation of fixing the fixture to the bulb mounting hole portion without complicating the structure of the fixture or the structure of the bulb mounting hole portion, and increases the fixing strength while preventing the fixture from being detached by an external force.

While the present invention has been described with reference to what are presently considered to be preferred embodiments thereof, it is understood that the invention is not limited to the disclosed embodiments or constructions. To the contrary, the invention is intended to cover various modifications and equivalent arrangements included within the spirit and scope of the appended claims.

What is claimed is:

1. A lamp bulb fixing structure comprising:

a bulb mounting hole portion formed in one of a lamp body of a lamp and a reflector of the lamp;

a fixture to be fixed to the bulb mounting hole portion, the fixture being capable of supporting a bulb in a detachably fixed manner, and the fixture having an interlocking portion that interlocks with a portion of the bulb mounting hole portion, said fixture further including a peripheral wall portion wherein said interlocking portion is within said peripheral wall portion; and an outer wall and an inner wall standing concentrically on the bulb mounting hole portion, the outer wall and the inner wall defining a space therebetween for receiving the peripheral wall portion of the fixture, wherein the fixture is fixed to the bulb mounting hole portion by the peripheral wall portion of the fixture entering said space so that the interlocking portion of the fixture interlocks with said portion of the bulb mounting hole portion.

2. A lamp bulb fixing structure according to claim 1, wherein a bottom portion of the fixture includes a bulb insert hole portion which defines a bulb insert hole provided with an engagement recess that associates with an engaging piece portion formed on the bulb, and the bulb insert hole portion has a clamping piece portion that has a guide piece portion for guiding the engaging piece portion of the bulb.

3. A lamp bulb fixing structure according to claim 1, wherein an upper end of the inner wall is slightly lower than an upper end of the outer wall.

4. A lamp bulb fixing structure according to claim 1, wherein one of the fixture and a wall unit that includes the inner wall and the outer wall has a protrusion and the other one of the fixture and the wall unit as a recess, wherein the protrusion is configured to fit into the recess to align the fixture with the wall unit.

5. A lamp bulb fixing structure according to claim 1, wherein a rib wall is provided standing in the space between the outer wall and the inner wall, and wherein the interlocking portion of the fixture includes an interlocking groove portion that is formed in the peripheral wall portion corresponding to the rib wall, and the interlocking groove portion has a claw portion that bites into the rib wall when engaged with the rib wall so as to fix the fixture to the bulb mounting hole portion.

6. A lamp bulb fixing structure according to claim 5, wherein the wall thickness of the rib wall slightly increases with progression from a top portion toward a bottom portion thereof.

7. A lamp bulb fixing structure according to claim 5, further comprising a plurality of rib walls which are arranged radially in the space between the inner wall and the outer wall.

8. A lamp bulb fixing structure according to claim 5, further comprising a plurality of interlocking groove portions each having a claw portion, and a plurality of rib walls corresponding to the number of the interlocking groove portions.

9. A lamp bulb fixing structure according to claim 5, wherein the claw portion is formed in each of two edge portions of the interlocking groove portion, the two edge portions facing each other.

10. A lamp bulb fixing structure according to claim 5, wherein a distal end of the claw portion has a generally triangular incisive shape.

11. A lamp bulb fixing structure comprising:

a bulb mounting hole portion formed in one of a lamp body of a lamp and a reflector of the lamp;

a fixture to be fixed to the bulb mounting hole portion, the fixture being capable of supporting a bulb in a detachably fixed manner, said fixture having an interlocking portion that interlocks with a portion of the bulb mounting hole portion, said fixture further including a peripheral portion; and an outer wall and an inner wall standing concentrically on the bulb mounting hole portion, the outer wall and the inner wall defining a space therebetween for receiving the peripheral portion of the fixture, wherein a rib wall is provided standing in the space between the outer wall and the inner wall, wherein the fixture is fixed to the bulb mounting hole portion by the peripheral portion of the fixture entering said space so that the interlocking portion of the fixture interlocks with said portion of the bulb mounting hole portion, wherein said interlocking portion of the fixture includes an interlocking groove portion that is formed in the peripheral portion corresponding to the rib wall, and the interlocking groove portion has a claw portion that bites into the rib wall when engaged with the rib wall so as to fix the fixture to the bulb mounting hole portion, wherein the peripheral portion of the fixture has a slit that is formed near the claw portion, and a deformable portion which is partially defined by the slit and which extends from an edge portion of the peripheral portion and which is projected from said edge portion of the peripheral portion, and wherein the claw portion is caused to bite into the rib wall by a movement occurring during deformation of the deformable portion caused when the fixture inserted in the space between the inner wall and the outer wall is pushed farther in.

12. A lamp bulb fixing structure according to claim 11, further comprising a plurality of deformable portions formed near the interlocking groove portion.

13. A lamp bulb fixing structure according to claim 11, wherein the deformable portion is projected substantially in an outwardly convex fashion so that an intermediate portion of the deformable portion is projected farther outward than other portions of the deformable portion.

14. A lamp bulb fixing structure comprising:

a bulb mounting hole portion formed in one of a lamp body of a lamp and a reflector of the lamp;

a fixture to be fixed to the bulb mounting hole portion, the fixture being capable of supporting a bulb in a detachably fixed manner, said fixture having an interlocking portion that interlocks with a portion of the bulb mounting hole portion, said fixture further including a peripheral portion; and an outer wall and an inner wall standing concentrically on the bulb mounting hole portion, the outer wall and the inner wall defining a space therebetween for receiving the peripheral portion of the fixture, wherein the fixture is fixed to the bulb mounting hole portion by the peripheral portion of the fixture entering said space so that the interlocking portion of the fixture interlocks with said portion of the bulb mounting hole portion, wherein the inner wall includes a portion in which a small groove portion is formed with the plane of a cross-section of the small groove portion extending in a circumferential direction, and wherein the interlocking portion is on a bottom portion of the fixture and includes a bendable interlocking piece portion that is formed at a position corresponding to the small groove portion, and the interlocking piece portion has an arrowhead-like portion, and wherein when the interlocking piece portion is bent, the interlocking piece portion interlocks with the small groove portion by the arrowhead-like portion biting into a wall portion that partially forms the small groove portion.

15. A lamp bulb fixing structure according to claim 14, further comprising a plurality of interlocking piece portions formed in the fixture, and a plurality of small groove portions formed in the inner wall.

16. A lamp bulb fixing structure according to claim 2, wherein said bottom portion lies substantially in a plane and said guide piece portion extends out of said plane and away from said bulb mounting hole portion.

17. A lamp bulb fixing structure according to claim 2, wherein said bottom portion is substantially perpendicular to said peripheral wall portion.

18. A lamp bulb fixing structure according to claim 9, wherein said claw portion is comprised of a claw on each of the two facing edge portions such that said claws are spaced at a distance which is smaller than the thickness of said rib.

19. A lamp bulb fixing structure according to claim 14, wherein said interlocking piece portion is substantially coplanar with said bottom portion before said fixture is mounted to said bulb mounting hole portion.

* * * * *